US006295923B1

(12) United States Patent
Berger

(10) Patent No.: US 6,295,923 B1
(45) Date of Patent: Oct. 2, 2001

(54) DEVICE WITH ECCENTRIC STAMPING WHEEL FOR STAMPING MOVING PARTS

(75) Inventor: Bruno Berger, Braunau (AT)

(73) Assignee: Seeber Engineering GmbH, Frankenburg (AT)

( * ) Notice: Subject to any disclaimer, the term of this patent is extended or adjusted under 35 U.S.C. 154(b) by 0 days.

(21) Appl. No.: 09/555,702

(22) PCT Filed: Dec. 4, 1998

(86) PCT No.: PCT/AT98/00294

§ 371 Date: Jun. 5, 2000

§ 102(e) Date: Jun. 5, 2000

(87) PCT Pub. No.: WO99/29516

PCT Pub. Date: Jun. 17, 1999

(30) Foreign Application Priority Data

| | | |
|---|---|---|
| Dec. 5, 1997 | (HU) | 40918/97 |
| Dec. 5, 1997 | (HU) | 40920/97 |
| Mar. 16, 1998 | (HU) | 9268/98 |

(51) Int. Cl.[7] ..... B44B 5/00

(52) U.S. Cl. ..... 101/93.18; 101/4; 101/5; 101/18

(58) Field of Search ..... 101/93.18, 35, 101/8, 9, 10, 18, 21, 27, 4, 5

(56) References Cited

U.S. PATENT DOCUMENTS

| | | | | |
|---|---|---|---|---|
| 3,852,988 | * | 12/1974 | Singhal | 101/5 |
| 3,964,383 | * | 6/1976 | Delligatti | 101/44 |
| 4,036,127 | | 7/1977 | Speicher | 101/5 |
| 4,557,191 | * | 12/1985 | Speicher | 101/4 |
| 5,393,288 | | 2/1995 | Miyasaka et al. | 483/1 |
| 6,200,044 | * | 3/2001 | Berger | 400/139 |

FOREIGN PATENT DOCUMENTS

| | | | |
|---|---|---|---|
| 0 244 035 | | 4/1987 | (EP) . |
| 0 285 597 | | 3/1988 | (EP) . |
| 285597 | * | 10/1988 | (EP) . |
| 9-309080 | * | 12/1997 | (JP) . |

* cited by examiner

*Primary Examiner*—Daniel J. Colilla
(74) *Attorney, Agent, or Firm*—Collard & Roe, P.C.

(57) ABSTRACT

The invention relates to a device for stamping distinguishing marks on parts moving in the feed direction of a roll line, comprising at least one mark-holder for holding a mark, the mark-holder being placed on the circumference of a stamping wheel. The inventive device comprises an eccentric stamping wheel which is mounted so as to rotate in a stamping unit and which can be accelerated in rotation by means of driving mechanism in synchronism with the speed of the parts to be stamped with a distinguishing mark. The stamping wheel applies a force on the parts to be stamped with a distinguishing mark which can be adjusted continuously and constantly. It is possible to adjust the horizontal, vertical and possibly oblique orientation of the stamping position of the stamping wheel. The inventive device is also characterized in that it comprises a range measuring device for the moving parts, which is used to control a horizontal driving mechanism for tracking the stamping unit carrying the stamping wheel.

5 Claims, 1 Drawing Sheet

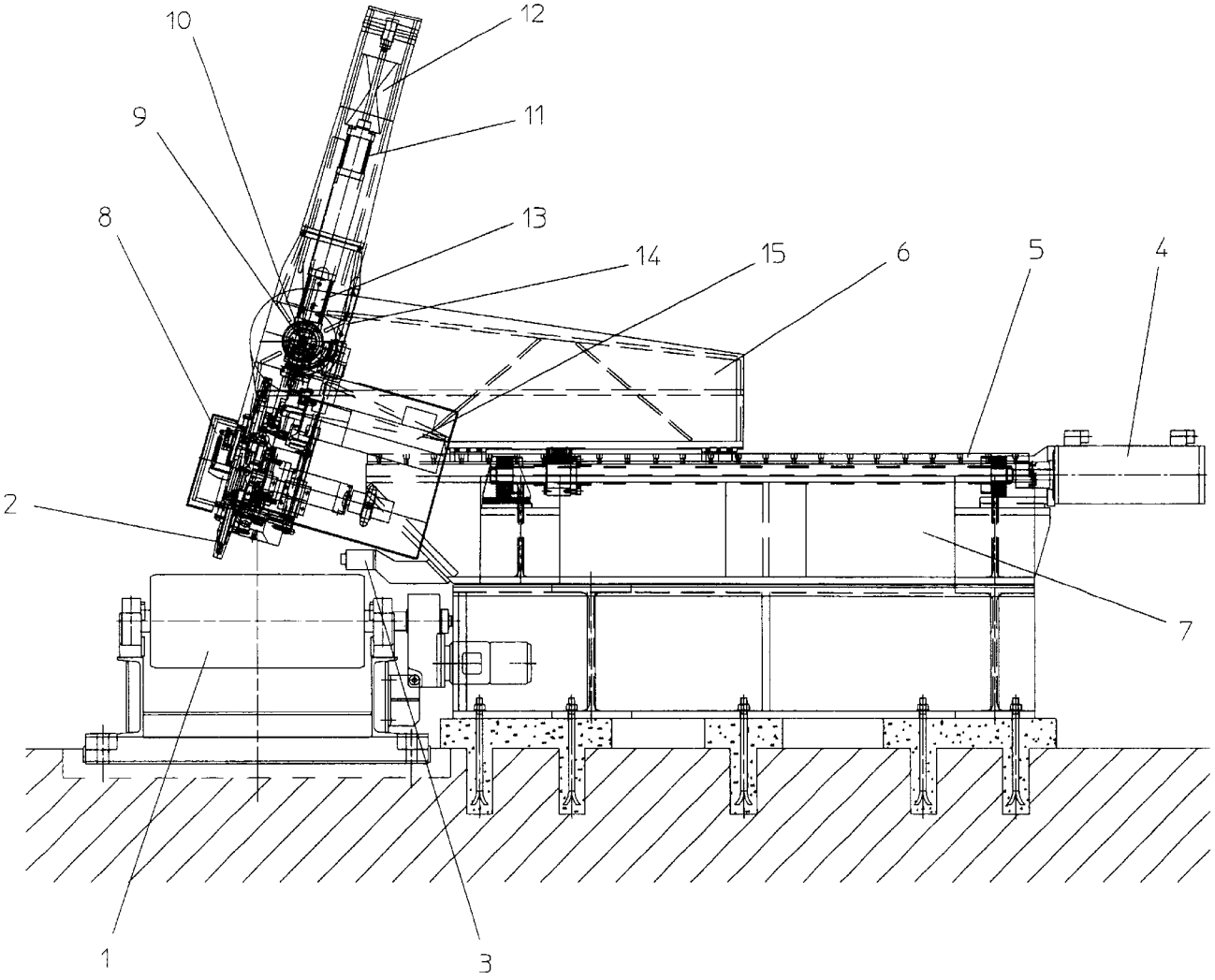
4
5
6
15
14
13
11
12
10
9
8
2
7
3
1

DEVICE WITH ECCENTRIC STAMPING WHEEL FOR STAMPING MOVING PARTS

The invention refers to a facility for marking of parts moving in the travelling direction of a roller table, provided with at least one character carrier carrying a character, with this at least one character carrier being inserted at the circumference of a stamping wheel.

It is the purpose of this invention to create a facility for successive marking of parts moving on a roller table, even at high travelling speed, in optional intervals with one or more characters. The characters in question may be different, or wholly, or partly identical.

This task is solved on the basis of a facility as mentioned above, on the one hand by means of an eccentric stamping wheel which, by means of a drive, is highly accelerable synchronous to the speed of the parts to be marked, and which is pivoted in a stamping unit, with the force of the stamping wheel exercised upon the parts to be marked being infinitely and constantly adjustable, and with a horizontal and vertical, or possibly inclined orientation of the stamping position of the stamping wheel being adjustable, and on the other hand by means of a distance meter for the moving parts, to control a horizontal drive for tracking the stamping unit carrying the stamping wheel.

The invention takes for granted that this facility is able to quickly and precisely mark parts, moving in the travelling direction of a roller table, successively with characters in short intervals. These characters may be single characters, as well as several different, or wholly, or partly identical characters. Due to the eccentricity of the stamping wheel, the stamping unit is lifted in its guiding system upon contact of the wheel with the parts to be marked, and marking of the parts is effected at a constant force exercised by the stamping unit. A continuous horizontal tracking of the stamping wheel in a position above the parts to be marked is possible by means of the distance meter.

Moreover, it will be favorable if the stamping unit is displaceable horizontally in a guide transverse to the travelling direction of the parts to be marked via the horizontal drive, and if it is equipped with a tilting drive for tilting the stamping unit into a stamping position of the stamping wheel vertical or slantwise above the parts to be marked. By means of these drives, the stamping wheel borne in the stamping unit may be placed with respect to its horizontal stamping position, as well as vertical or slantwise above the parts to be marked.

Moreover, it may be convenient if the facility is provided with at least one drive for adjustment of the stamping wheel against the moving parts, using one drive for coarse adjustment and one for fine adjustment of the stamping wheel against the parts to be marked. By means of the drive for coarse adjustment, the stamping wheel is moved into a preliminary position above the parts to be marked, the drive for fine adjustment moves the stamping wheel into its final position above the parts to be marked, immediately before the stamping procedure.

It is also recommended that the eccentricity of the stamping wheel be designed in a way that the stamping wheel touches the parts to be marked at a point immediately before the at least one character carrier inserted at the wheel circumference, and that the parts to be marked press the stamping wheel upward against a constant force. Thus counterbalancing this pressure at a constant, adjustable force, the marking procedure proper of the parts with at least one character carrier inserted at the circumference of the stamping wheel takes its course while the stamping wheel is turning.

It will also be favorable, if the constant force exercised by the stamping wheel to the parts to be marked is adjustable via a hydraulic drive. By means of this drive, the force can be adjusted as a function of the respective part to be marked and kept constant during the stamping procedure.

Finally, a facility is provided, where the parts moving in the travelling direction of the roller table are sections. In this case the invention has particularly proved its worth, for example, if several characters shall be stamped in intervals to railway rails.

Hereinafter, the invention will be explained on the basis of an exemplary design type as represented in the drawing, which shows a schematic side view of the facility according to the invention, for marking of parts moving in the travelling direction of a roller table.

By means of a horizontal drive 4, a horizontal carriage 6 is moved to the preliminary position required for the respective parts to be marked, from its rear home position on a base frame 7, via horizontally arranged guides 5, as a function of the theoretical horizontal position of the parts to be marked on a roller table 1. These parts to be marked are usually sections, rails, tubes and other elongated stock, which are generally marked as long as they are hot, but they may also be short component parts.

Depending on the kind of parts to be marked, simultaneously with or immediately after this sequence a stamping unit 8 is turned around a center of motion 9 into a position vertical or slantwise to the marking area, where it is locked. This movement is effected by means of a tilting drive 10 arranged centrical to the rotating axis.

Depending on the kind of parts moving on the roller table, simultaneously with or immediately after this tilting motion, the stamping unit 8 is moved into a required preliminary position vertical to the marking area, by means of a hydraulic drive 11 intended for coarse adjustment. Above the theoretical marking area the stamping unit is clamped by means of a clamping facility 12.

After activation of a distance meter 3, the horizontal distance of the stamping unit to the respective part to be marked is continuously and actively measured. On the basis of the measured data determined by the distance meter 3, the horizontal carriage 6 is continuously tracking the parts to be marked via its horizontal drive 4. Thus an eccentric stamping wheel 2, pivoted in the stamping unit 8 and driven by a drive 15 is continuously kept precisely above the required marking area of the parts or sections, following the horizontal deviations of the parts from a reference position on the roller table 1.

Immediately before the marking procedure takes place, the stamping unit 8 is moved to its lower stop position vertically above the parts to be marked, by means of another hydraulic drive 13 intended for fine adjustment of the stamping unit. Thus the stamping wheel 2 is stopped approx. 10 mm above the surface to the marked, as a function of the parts to be marked as well as the pertinent presetting done by the hydraulic drive 11.

Then the stamping wheel 2 pivoted in the stamping unit 8, at the circumference of which at least one character carrier (in the example, there are several character carriers) carrying characters is inserted in a segment of it, is accelerated by means of the drive 15, synchronous to the speed of the parts to be marked moving on the roller table 1, allowing for speed variations of the parts travelling on the roller table 1.

After partial acceleration of the stamping wheel 2 via the drive 15 borne parallel to the rotating axis of the stamping wheel 2, the stamping wheel 2 and the parts moving on the roller table 1 get into contact due to the eccentricity of the stamping wheel. This contact occurs immediately before the character carrier inserted in the circumference of the stamping wheel 2.

The force exercised in the procedure on the stamping wheel 2 by the relevant part to be marked lifts the stamping unit 8 which is suspended movable in a guiding mechanism 14. This force is counterbalanced via the hydraulic drive 13, so that marking of the parts is effected at a constant force adjustable for the relevant parts, as the stamping wheel 2 with the character carrier inserted in it rolls over the part to be marked at this constant force.

Marking of the parts may be done in varying or in identical intervals, with the relevant intervals being optionally adjustable.

After this marking procedure, the stamping wheel 2 moves away from the marked part, due to its eccentricity.

Now the stamping wheel (2) is either decelerated, or it keeps rotating at a circumferential speed synchronous to the travelling speed of the parts to be marked, and marking of the parts, as described above, can be repeated. The same part can be marked again at another spot, or another part moving on the roller table is marked.

After a part to be marked has passed the facility, all drives can be either moved to their reference position or home position, or they can remain in their current position, or be moved to a new preliminary position—for instance for a new part to be marked—, and the marking procedure can take place for the same part or another one.

For exchanging of one or more character carriers inserted in the stamping wheel, there are basically two exchange mechanisms available. For exchanging single character carriers inserted in the stamping wheel, but particularly for exchanging a number of character carriers inserted in the stamping wheel, a character carrier exchange mechanism is usually attached, as it is known from a parallel application for patent (Hungarian application number P 97 02 364). By means of this mechanism, the stamping wheel borne in the stamping unit is slued out in the immediate vicinity of the character carrier hopper, in such a way that the character carriers of the stamping wheel can be exchanged for those from the character carrier hopper, and vice versa.

There is a so-called single character carrier exchange mechanism integrated inside the stamping wheel 2, which is particularly appropriate for exchanging a single character carrier. The time required for such an exchange sequence is of the order of one second. Such a mechanism is described in a parallel application, too (Hungarian application number P 98 00 579).

What is claimed is:

1. An apparatus for marking a surface of parts moving on a roller table in a travelling direction at a predetermined speed, which comprises (a) a stamping unit displaceable against an infinitely adjustable force transversely to the surface of the parts to be marked, (b) a drive for adjusting the stamping unit perpendicularly to the travelling direction and parallel to the surface of the parts to be marked, (c) a measuring device controlling the adjusting drive in response to a measured transverse distance between the stamping unit and the parts to be marked, (d) an eccentric stamping wheel carrying on its circumference a character carrier for at least one character and rotatable in the stamping unit about an axis of rotation extending perpendicularly to the travelling direction and parallel to the surface of the parts to be marked, the stamping wheel having a cylindrical surface eccentric to the axis of rotation, and (e) a drive for rotating the stamping wheel at a high speed of acceleration and synchronously to the speed of the parts moving in the travelling direction about the axis of rotation.

2. The apparatus of claim 1, wherein the stamping unit is tiltable about an axis extending parallel to the travelling direction.

3. The apparatus of claim 1, further comprising guides extending transversely to the travelling direction and parallel to the surface of the parts to be marked, the stamping unit being displaceably mounted in said guides.

4. The apparatus of claim 1, further comprising a drive for coarse adjustment of the stamping unit and another drive for fine adjustment of the stamping unit.

5. The apparatus of claim 1, comprising a hydraulic drive for adjusting the infinitely adjustable force opposed to the transverse displacement of the stamping unit.

* * * * *